US006071835A

United States Patent [19]

Tang et al.

[11] Patent Number: 6,071,835

[45] **Date of Patent: *Jun. 6, 2000**

[54] LOAD LIMITING WEBBING

[75] Inventors: Weiming Tang, Lake Hiawatha; Frank Mares, Whippany, both of N.J.; Zafarur X. Rahman, Midlothian; Monte L. Nagy, Jr., Chester, both of Va.

[73] Assignee: AlliedSignal Inc., Morristown, N.J.

[ * ] Notice: This patent is subject to a terminal disclaimer.

[21] Appl. No.: 09/098,294

[22] Filed: Jun. 16, 1998

[51] Int. Cl.[7] ..... D03D 3/03

[52] U.S. Cl. ..... 442/216; 442/1; 442/203; 139/383 R; 264/210.5; 280/805; 297/471

[58] Field of Search ..... 442/1, 216, 203; 139/383 R; 264/210.5; 280/805; 297/471

[56] References Cited

U.S. PATENT DOCUMENTS

| | | | |
|---|---|---|---|
| 2,934,397 | 4/1960 | Landerl | 8/531 |
| 3,098,691 | 7/1963 | Pascal | 8/576 |
| 3,154,374 | 10/1964 | Gruschke et al. | 8/130.1 |
| 3,296,062 | 1/1967 | Truslow | 44/89 |
| 3,322,163 | 5/1967 | Hughes | 139/383 R |
| 3,408,433 | 10/1968 | Brayford | 264/172.14 |
| 3,418,065 | 12/1968 | Bount et al. | 8/476 |
| 3,464,459 | 9/1969 | Ballard | 139/383 R |
| 3,486,791 | 12/1969 | Stoffel et al. | 297/472 |
| 3,530,904 | 9/1970 | Ballard | 139/383 R |
| 3,550,957 | 12/1970 | Radke et al. | 297/472 |
| 3,614,798 | 10/1971 | Serbin | 8/476 |
| 3,671,620 | 6/1972 | Inoue | 264/172.17 |
| 3,756,288 | 9/1973 | Seo et al. | 139/383 R |
| 3,823,748 | 7/1974 | Allman et al. | 139/383 R |
| 3,841,831 | 10/1974 | Miller | 8/532 |
| 3,872,895 | 3/1975 | Takada | 139/383 R |
| 3,895,909 | 7/1975 | Greer | 8/400 |
| 3,914,502 | 10/1975 | Hayashi et al. | 428/336 |
| 3,926,227 | 12/1975 | Takada et al. | 139/383 R |
| 3,927,167 | 12/1975 | Reese | 264/210.5 |
| 3,957,905 | 5/1976 | Sumoto et al. | 523/460 |
| 4,031,165 | 6/1977 | Saiki et al. | 525/444 |
| 4,045,401 | 8/1977 | Steumark et al. | 523/324 |
| 4,110,411 | 8/1978 | Imanaka et al. | 525/92 A |
| 4,138,157 | 2/1979 | Pickett et al. | 297/442 |
| 4,228,829 | 10/1980 | Kikuchi | 139/408 |
| 4,500,686 | 2/1985 | Kobayashi et al. | 525/408 |

U.S. PATENT DOCUMENTS

FOREIGN PATENT DOCUMENTS

| | | |
|---|---|---|
| 208131 | 6/1986 | European Pat. Off. . |
| 697428 | 8/1995 | European Pat. Off. . |
| 19513259 | 10/1996 | Germany . |
| 4115 | 2/1973 | Japan . |
| 4116 | 2/1973 | Japan . |
| 49037 | 12/1977 | Japan . |
| 157117 | 9/1984 | Japan . |
| 253764 | 9/1984 | Japan . |
| 60031525 | 2/1985 | Japan . |
| 2097519 | 4/1990 | Japan . |
| 2097520 | 4/1990 | Japan . |
| 2099554 | 4/1990 | Japan . |
| 2099555 | 4/1990 | Japan . |
| 252729 | 10/1990 | Japan . |
| 259918 | 11/1991 | Japan . |
| 72325 | 3/1992 | Japan . |
| 27268 | 5/1992 | Japan . |
| 4-257336 | 9/1992 | Japan . |
| 5059192 | 3/1993 | Japan . |
| 57302 | 8/1993 | Japan . |
| 6172507 | 6/1994 | Japan . |
| 90717 | 4/1995 | Japan . |
| 947661 | 1/1964 | United Kingdom . |
| 1556917 | 11/1979 | United Kingdom . |

OTHER PUBLICATIONS

Principles of Polymer Chemistry by Paul J. Flory (1953) pp. 308–310.

Textile Research Institute, "Identifying Critical Process Variables in Poly(ethylene Terephthalate Melt Spinning", by A. Dutta & V. Nadkarni, (Jan. 1984) pp. 35–42.

Journal of Polymer Science 12, (1974) "Viscosity–Molecular Weight Relationship for Fractional Poly(ethylene Terephthalate", by William L. Hergenrother & Charles J. Nelson, pp. 2905–2915.

Textile Research Journal 66(11), (1996) "Effects of Molecular Weight on Melt Spinning and Mechanical Properties of High Performance Poly(ethylene Terephthalate) Fibers", by Andrzej Ziabicki, pp. 705–712.

Journal of Applied Polymer Science 22 (1978) "Molecular Weight–Viscosity Relationships for Poly (1 4–butylene Terephthalate)", by W.F.H. Borman, pp. 2119–2126.

T. Murphy, "Buckling Up for the Future", Ward's Auto-World, 95 (1997).

*Primary Examiner*—Terrel Morris
*Assistant Examiner*—John J. Guarriello
*Attorney, Agent, or Firm*—Melanie L. Brown; Virginia S. Andrews; Roger H. Criss

[57] ABSTRACT

The present webbing has a force-displacement profile characterized by:

(a) when the webbing is subjected to a knuckle point force in the range from about 400 pounds (about 1.8 kilonewtons) to about 900 pounds (about 4.0 kilonewtons), the webbing elongates to less than about five percent;

(b) upon subjecting the webbing to greater than the knuckle point force and to less or equal to about 1,400 pounds (about 6.2 kilonewtons), the webbing elongates further to at least about ten percent; and (c) upon subjecting the webbing to greater than 1,400 pounds (about 6.2 kilonewtons), the modulus increases sharply and the webbing elongates further until the webbing breaks at a tensile strength of at least about 5,000 pounds (about 22 kilonewtons).

The present webbing is useful for seat belts, parachute harnesses and lines, shoulder harnesses, cargo handling, safety nets, trampolines, safety belts or harnesses for workers at high attitudes, military arrestor tapes for slowing aircraft, ski tow lines, and in cordage applications such as for yacht mooring or oil derrick mooring.

24 Claims, 9 Drawing Sheets

U.S. PATENT DOCUMENTS

| | | | |
|---|---|---|---|
| 4,584,353 | 4/1986 | Kobayashi et al. | 525/438 |
| 4,670,498 | 6/1987 | Furusawa et al. | 524/381 |
| 4,670,510 | 6/1987 | Kobayashi et al. | 525/89 |
| 4,680,345 | 7/1987 | Kobayashi et al. | 525/437 |
| 4,694,049 | 9/1987 | Morita et al. | 525/440 |
| 4,710,423 | 12/1987 | Imamura | 442/764 |
| 4,902,299 | 2/1990 | Anton | 8/442 |
| 4,942,219 | 7/1990 | Yatsuka et al. | 528/272 |
| 4,945,191 | 7/1990 | Satsuka et al. | 174/69 |
| 5,225,497 | 7/1993 | Ishii | 525/437 |
| 5,376,440 | 12/1994 | Koseki | 442/203 |
| 5,547,143 | 8/1996 | Miller, III et al. | 242/379.1 |
| 5,646,077 | 7/1997 | Matsunega et al. | 442/415 |
| 5,656,700 | 8/1997 | Kagi et al. | 525/437 |
| 5,716,568 | 2/1998 | Kaegi et al. | 264/103 |
| 5,830,811 | 11/1998 | Tang et al. | 442/216 |
| 5,869,582 | 2/1999 | Tang et al. | 525/415 |

LOAD LIMITING WEBBING

BACKGROUND OF THE INVENTION

A typical vehicle safety seat belt system is designed to restrict the displacement of an occupant with respect to the occupant's seated position within the vehicle when the vehicle experiences a sudden, sharp deceleration. (See U.S. Pat. No. 3,322,163). A typical seat belt has three main portions: the retractor belt, the torso belt, and the lap belt and the performance of each belt may be characterized by its force-displacement curve. The area under the force-displacement curve is referred to as the energy absorbed by the safety restraint.

Current vehicle safety seat belts are made from fully drawn polyethylene terephthalate ("PET") fiber which is partially relaxed (2.7%) and having a tenacity of at least 7.5 grams/denier and 14% elongation at break. U.S. Government regulation requires that seat belts must withstand loads up to 6,000 lbs. However, a problem exists with the current PET fiber based seat belts. Crash studies indicate that after the initial vehicle impact occurs (e.g. at a speed of about 35 miles/hour), the occupant tends to move forward from his seated position until the belt engages to build restraining forces. As indicated in FIG. 1, the relatively unyielding belt made from PET fiber exerts a force of at least 2,000 pounds (about 9,000 Newtons) against the occupant at the seat belt torso position so as to cause the occupant to have high chest, rib cage, head, neck, and back injuries when the occupant rebounds and impacts the back structure of the seat assembly.

When a car collides at a speed of 35 miles/hour, an impact energy to which an average sized person in the car is subjected is at least 500 Joules on the torso belt. Although the current PET fiber may absorb the impact energy, damage to the vehicle occupant still occurs due to the undesirable fiber force-displacement curve. In 70 milliseconds, an average sized passenger will experience high forces of up to 2,000 pounds (about 9,000 Newtons) as shown in FIG. 1.

In order to absorb the impact energy and to reduce the seat belt load against the vehicle occupant, U.S. Pat. No. 3,550,957 discloses a shoulder harness having stitched doubled sections of the webbing arranged above the shoulder of the occupant so that the stitching permits the webbing to elongate from an initial length toward a final length at a controlled rate under the influence of a predetermined restraining force. However, the stitched sections do not give the desirable amount of energy absorption, do not provide uniform response, and are not reusable in multiple crashes. See also U.S. Pat. No. 4,138,157.

U.S. Pat. No. 3,530,904 discloses a woven fabric which is constructed by weaving two kinds of yarns having relatively different physical properties and demonstrates energy absorption capability. U.S. Pat. Nos. 3,296,062; 3,464,459; 3,756,288; 3,823,748; 3,872,895; 3,926,227; 4,228,829; 5,376,440; and Japanese Patent 4-257336 further disclose webbings which are constructed of multiple kinds of warp yarns having different tenacity and elongations at break. DE 19513259A1 discloses webbings which are constructed of short warp threads which will absorb the initial tensile load acting on the webbing and also longer warp threads which will absorb the subsequent tensile load acting on said webbing.

Those skilled in this technical area have recognized the deficiencies in using at least two different yarn types as taught by the preceding references. U.S. Pat. No. 4,710,423 and Kokai Patent Publication 298209 published on Dec. 1, 1989 ("Publication 298209") teach that when using at least two different yarn types, energy absorption occurs in a stepwise manner and thus, the web does not absorb the energy continuously and smoothly. Therefore, after one type of warps absorbs a portion of the impact energy, and before another type of warps absorbs another portion of the impact energy, the human body is exposed to an undesirable shock.

UK Patent 947,661 discloses a seat belt which undergoes an elongation of greater than or equal to 33 percent when subjected to at least 70% of the breaking load. This reference does not teach or suggest the present load limiting yarn.

U.S. Pat. No. 3,486,791 discloses energy absorbing devices such as a rolled up device which separates a slack section of the belt from the taut body restraining section by clamping means which yield under a predetermined restraining force to gradually feed out the slack section so that the taut section elongates permitting the restrained body to move at a controlled velocity. The reference also describes a device which anchors the belt to the vehicle by an anchor member attached to the belt and embedded in a solid plastic energy absorber. These kinds of mechanical devices are expensive, are not reusable, provide poor energy absorption, and are difficult to control. An improvement on the foregoing devices is taught by U.S. Pat. No. 5,547,143 which describes a load absorbing retractor comprising: a rotating spool or reel, seat belt webbing secured to the reel; and at least one movable bushing, responsive to loads generated during a collision situation, by deforming a portion of the reel and in so doing dissipating a determined amount of the energy. This kind of mechanical device is built-in with a specific amount of load limiting and energy absorption towards certain sized occupants, and cannot be adjusted to the needs of different sized occupants in real transportation scenario. Furthermore, this kind of mechanical device is not reusable to limit the load in multiple crashes since the reel is deformed permanently in the first vehicle collision.

U.S. Pat. No. 4,710,423 and Publication 298209 disclose webbing comprised of relaxed polyethylene terephthalate ("PET") yarns having tenacity of at least 4 grams/denier and an ultimate elongation of from 50% to 80%. Due to the inherent physical properties of PET yarn (e.g. glass transition temperature=75° C.), the examples of U.S. Pat. No. 4,710,423 and Publication 298209 show that, at 5% elongation, the load has already reached more than 1,500 lbs (about 6,700 Newtons). The damage to the occupant by the seat belt still exists and thus, the belt material needs to be further modified. Examples in these two patents also show that if PET yarn is overrelaxed, the yarn tenacity drops to 2.3 grams/denier.

Kokai Patent Publication 90717 published on Apr. 4, 1995 discloses high strength polybutylene terephthalate homopolymer ("PBT") fiber based energy absorption webbing. The fiber's tenacity is over 5.8 grams/denier, breaking elongation is over 18.0%, and the stress at 10% elongation is less than 3.0 grams/denier. However, this reference fails to teach PBT fiber demonstrating the initial stress requirement which engages the seat belt to protect the occupant and the means to control the initial stress barrier. A low initial stress barrier of yarn results in a low knuckle force point of the finished seat belt which allows excessive excursion of occupant and leads to serious injuries.

The present inventors in commonly assigned U.S. Pat. Nos. 5,869,582 and 5,830,811; and U.S. patent application Ser. No. 09/083,493 filed May 22, 1998 have provided a load limiting seat belt with an improved energy absorption, which has a smoother performance than that of the known stitched webbing approach or the known use of at least two different fibers, is reusable in multiple crashes unlike the known mechanical clamp and device approach, and also addresses the ability to control the initial stress barrier and the impact energy absorption from different sized vehicle occupants. Also see T. Murphy, "Buckling Up for the Future", WARD's Auto World, 95 (1997).

It would be advantageous to have a process for dyeing and stabilizing said load limiting seat belt with improved energy absorption including an acceptable knuckle point force wherein the process would not be detrimental to the belt's energy absorption properties.

Known processes for dyeing PET fiber exist. U.S. Pat. Nos. 2,934,397 and 3,098,691 teach a process of exhaust dyeing PET fiber, which comprises treating the fiber around the boiling temperature, i.e. 100° C., with an aqueous dispersion of a disperse dye in the presence of a carrier comprising dimethyl terephthalate or dioxane, respectively. U.S. Pat. No. 3,154,374 teaches a process to improve PET fiber dyeing, which comprises treating the filaments during a period of from $10^{-4}$ second to ten seconds at a temperature from 200° C. to 350° C. with a swelling agent, e.g., sebacic acid dimethyl ester, before dyeing.

Those skilled in this technical area have recognized the deficiencies in using the carrier as taught by the preceding references. The background section of U.S. Pat. No. 3,841,831 teaches that the so-called "carrier" process is not entirely satisfactory since the carrier addition renders the dyeing process more expensive and the colorings obtained by this method have a less than desired lightfastness. In addition, carriers often exhibit some degree of toxicity, often have strong odors, and can be difficult to remove from the fibers. This reference further teaches a process for dyeing PET fiber by immersing the fiber in disperse dye liquor for more than ten minutes and using dry heat at a temperature between 120° C. to 230° C.

Man-Made Fibers, Volume 3, page 537 (1968) teaches the thermosol process which involves padding fabric with water-insoluble dye aqueous dispersion, drying padded fabric, and exposing to high temperature (120 to 200° C.). U.S. Pat. No. 3,418,065 teaches a process for dyeing fabrics comprising PET fibers by using steam at about 120° C. under pressure in a sealed vessel. U.S. Pat. No. 3,614,798 teaches a process of setting a reactive dye on a dyed web wherein the process comprises passing the web under tension of 400–500 pounds per square inch through an atmosphere of steam at around 104° C. at superatmospheric pressure of 1.3–2.3 pounds per square inch until the dye is set. U.S. Pat. No. 3,895,909 teaches a process of dyeing, drying, thermosoling, washing, and drying PET fabrics for seat belts. The dyed and predried fabrics are thermosoled in an infrared oven set at a temperature of about 205° C., which is close to PET's melting temperature of 265° C. Example 1 teaches that tension on the contracting belt ranged from 100–300 pounds. See also British Patent 1,556,917. It would be desirable to have a process to effectively dye load limiting seat belt while tailoring the stress-strain curve of the resulting dyed webbing.

Furthermore, as the use of polyester materials has increased in automotive industry, it becomes more demanding for polyester to meet the requirements for dye fastness and ultraviolet ("UV") stability. U.S. Pat. No. 4,902,299 teaches that the automotive industry requires dyed fabrics to withstand 488.8 kilojoules/meter$^2$ (KJ/m$^2$) exposure in the Xenon arc Weather-Ometer. This prolonged exposure to UV light (weathering) presents a serious problem, such as a high level of dye fading, strength loss, physical property degradation and stress-strain curve change of load limiting seat belt. It would be desirable to have load limiting seat belt with good dye fastness and improved UV stability.

SUMMARY OF THE INVENTION

The present invention responds to the foregoing needs by providing a webbing having a force-displacement profile characterized by:

(a) when the webbing is subjected to a knuckle point force in the range from about 400 pounds (about 1.8 kilonewtons) to about 900 pounds (about 4.0 kilonewtons), the webbing elongates to less than about five percent;

(b) upon subjecting the webbing to greater than the knuckle point force and to less or equal to about 1,400 pounds (about 6.2 kilonewtons), the webbing elongates further to at least about ten percent; and (c) upon subjecting the webbing to greater than 1,400 pounds (about 6.2 kilonewtons), the modulus increases sharply and the webbing elongates further until the webbing breaks at a tensile strength of at least about 5,000 pounds (about 22 kilonewtons).

Preferably, the webbing in part (a) elongates to less than about three percent. Preferably, the webbing in part (b) elongates to at least about 15 percent.

The term "knuckle point force" as used herein means on the force-displacement curve, an intersecting point of an extrapolation line from a steeply sloped portion of the curve appearing at an initial stage of the elongation of the webbing with an extrapolation line from a slightly sloped portion of the curve appearing after the initial stretching of webbing. For example, see FIG. 2.

The term "modulus" as used herein means the slope of the force-displacement curve.

The present invention is advantageous because the present webbing has better impact energy absorption and a smoother performance than that of the known stitched webbing approach or the known use of at least two different fibers, is reusable unlike the known mechanical device, and also addresses the ability to control the initial stress barrier and the impact energy absorption. The present invention also provides a process for dyeing and stabilizing the webbing while maintaining the desirable stress-strain curve of the webbing.

Other advantages of the present invention will be apparent from the following description, attached drawings, and attached claims.

DETAILED DESCRIPTION OF THE INVENTION

Figure 1:
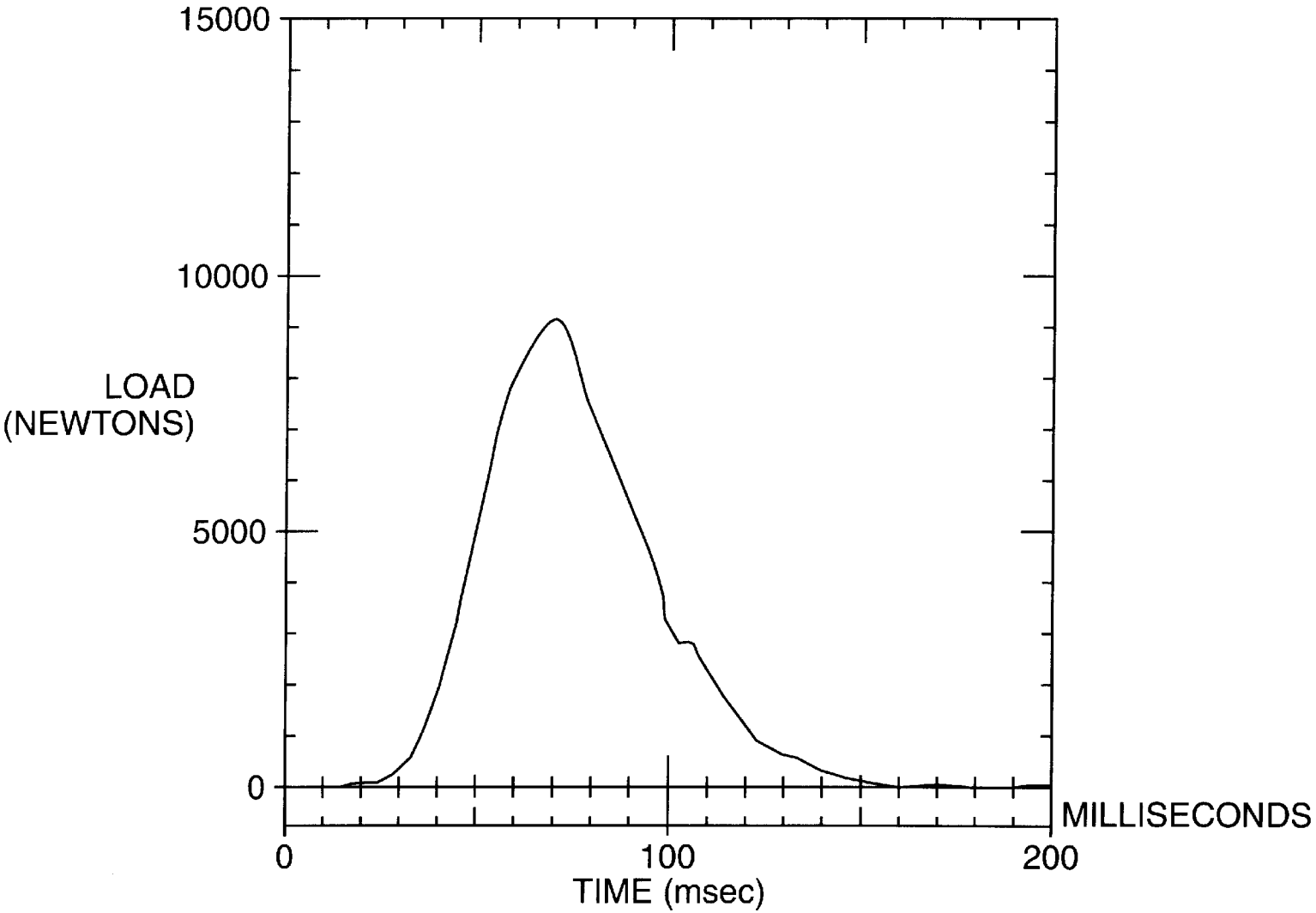
FIG. 1 illustrates the performance (with load as a function of time) of a known poly(ethylene terephthalate) homopolymer seat belt at the torso position in a vehicle collision.
Figure 2:
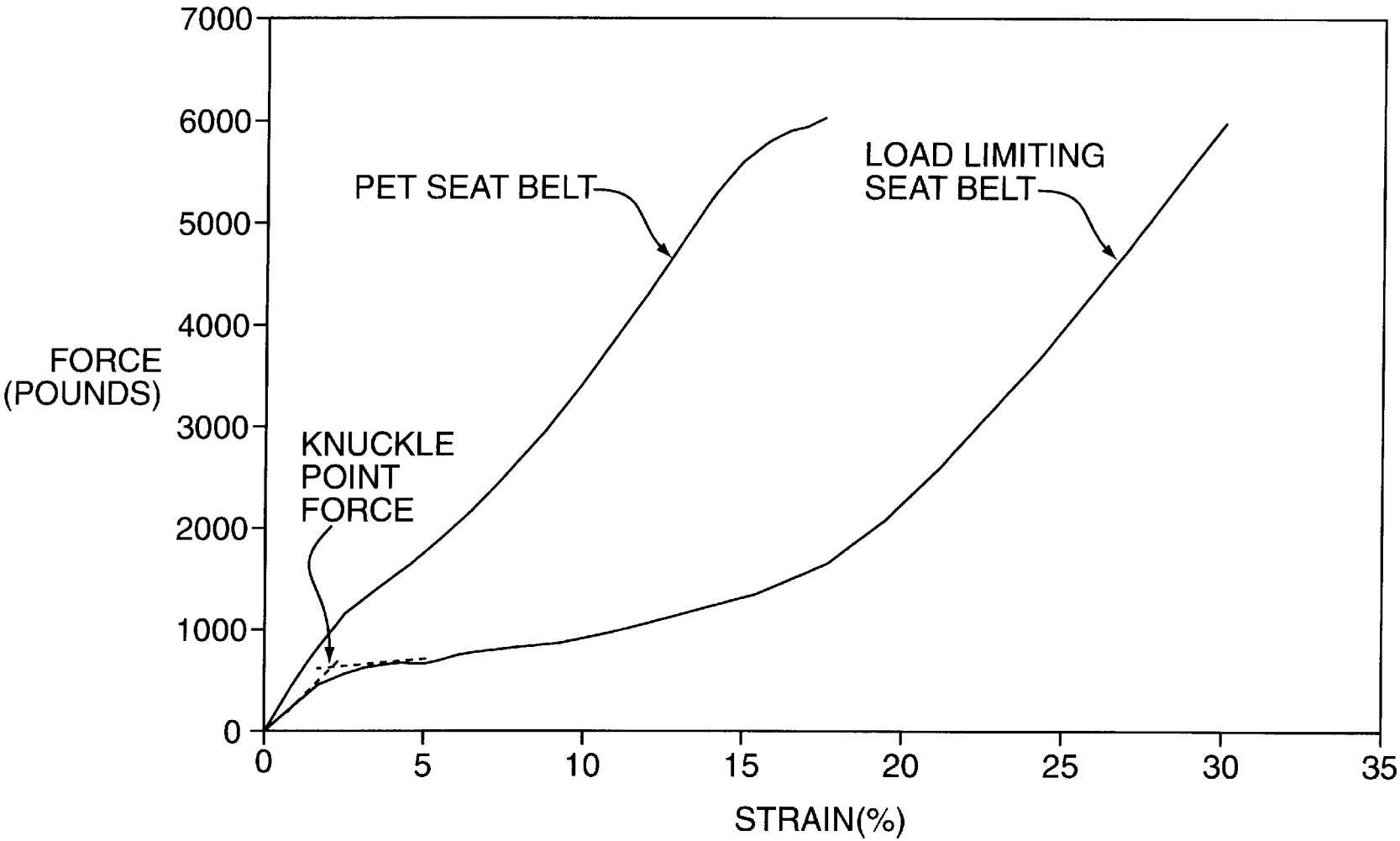
FIG. 2 illustrates a stress-strain curve of the webbing of the present invention.

Referring to FIG. 2, the present invention provides a webbing having a force-displacement profile characterized by:

(a) when the webbing is subjected to a knuckle point force in the range from about 400 pounds (about 1.8 kilonewtons) to about 900 pounds (about 4.0 kilonewtons), the webbing elongates to less than about five percent;

(b) upon subjecting the webbing to greater than the knuckle point force and to less or equal to about 1,400 pounds (about 6.2 kilonewtons), the webbing elongates further to at least about ten percent; and (c) upon subjecting the webbing to greater than 1,400 pounds (about 6.2 kilonewtons), the modulus increases sharply and the webbing elongates further until the webbing breaks at a tensile strength of at least about 5,000 pounds (about 22 kilonewtons).

The webbing is made from yarn spun from a polymer having a glass transition temperature in the range from preferably about −40° C. to about +70° C., more preferably about −20° to about +60° C., and most preferably about +35° C. to about +55° C. The polymer may be a homopolymer, random copolymer, diblock copolymer, triblock copolymer, or segmented block copolymer.

Examples of preferred homopolymers include polytrimethylene terephthalate; polyisobutylene terephthalate; and long chain alkylene terephthalates and naphthalate polymers.

Examples of preferred random copolyesters include copolyester which, in addition to the ethylene terephthalate unit, contain components such as ethylene adipate, ethylene sebacate, or other long chain alkylene terephthalate units. This component is present in an amount greater than 10 percent.

Examples of preferred block copolymers include diblock, triblock, and segmented block structure. Block copolymers comprise at least one hard crystalline aromatic polyester block and at least one soft amorphous aliphatic polyester block. The crystalline aromatic polyester includes the homopolymers such as polyethylene terephthalate ("PET"); polytrimethylene terephthalate; polybutylene terephthalate; polyisobutylene terephthalate; poly(2,2-dimethylpropylene terephthalate); poly[bis-(hydroxymethyl)cyclohexene terephthalate]; polyethylene naphthalate ("PEN"); polybutylene naphthalate; poly[bis-(hydroxymethyl)cyclohexene naphthalate]; other polyalkylene or polycycloalkylene naphthalates and the mixed polyesters which, in addition to the ethylene terephthalate unit, contain component such as ethylene isophthalate; ethylene adipate; ethylene sebacate; 1,4-cyclohexylene dimethylene terephthalate; or other long chain alkylene terephthalate units. Commercially available aromatic polyesters may be used. A mixture of aromatic polyesters may also be used. The more preferred aromatic polyesters include PET and PEN.

Preferably, in the block copolymer, the aromatic polyester has: (i) an intrinsic viscosity which is measured in a 60/40 by weight mixture of phenol and tetrachloroethane at 25° C. and is at least about 0.6 deciliter/gram and (ii) a Newtonian melt viscosity which is calculated to be at least about 7,000 poises at 280° C. The intrinsic viscosities, as measured in a 60/40 by weight mixture of phenol and tetrachloroethane, of the preferred aromatic polyesters are about 0.8 for PET and about 0.6 for PEN. The more preferred IV for PET is 0.9 and for PEN is 0.7. The Newtonian melt viscosity of PET (with an IV=1) is calculated to be about 16,400 poise at 280° C. and the Newtonian melt viscosity of PEN (with an IV=1) is greater than PET's melt viscosity.

Preferably, in the block copolymer, the amorphous aliphatic polyester block is made from lactone monomer. Preferred lactone monomers include s-caprolactone, propiolactone, butyrolactone, valerolactone, and higher cyclic lactones. The most preferred lactone monomer is ϵ-caprolactone. Commercially available lactone monomers may be used. Two or more types of lactones may be used simultaneously.

The PET-polycaprolactone block copolymer may have a polycaprolactone concentration of preferably about 10 to about 30 weight percent. In the block copolymer, the polycaprolactone concentration may be varied to achieve webbing having the desired initial stress barrier and impact energy absorption with load limiting performance.

Preferably, the process for making a block copolymer useful in the yarn for the present load limiting webbing occurs in a twin screw extruder and comprises the consecutive steps of:

(A) forwarding aromatic polyester melt to an injection position in a twin screw extruder wherein the aromatic polyester melt has (i) an intrinsic viscosity which is measured in a 60/40 by weight mixture of phenol and tetrachloroethane and is at least about 0.6 deciliter/gram and (ii) a Newtonian melt viscosity which is calculated to be at least about 7,000 poise at 280° C.;

(B) injecting lactone monomer into the molten aromatic polyester of step (A);

(C) dispersing the injected lactone monomer into the aromatic polymer melt so that a uniform mixture forms in less than about thirty seconds; and (D) reacting the uniform mixture resulting from step (C) at a temperature from about 250° C. to about 280° C. to form a block copolymer. All of steps (A) to (D) occur in less than about four minutes residence time in the twin screw extruder.

Step (A) for making the block copolymer in a twin screw extruder comprises forwarding aromatic polyester melt to an injection position. The aromatic polyester is added to the twin screw extruder. The aromatic polyester may be molten and then fed by a melt metering pump to the twin screw extruder or the aromatic polyester may be fed in pellet form fed by a weight-in-loss feeder to the twin screw extruder and then melted in the twin screw extruder. As those skilled in the art know, a weight-in-loss feeder has a hopper filled with pellets and the feeding rate is controlled by weight loss of pellets from the hopper. If aromatic polyester melt from a reactor is used as the starting material, intermeshing close conveying elements may be used to forward the melt downstream. If aromatic polyester pellets are used as the starting material, preferably intermeshing open, open to close, and close conveying elements are assembled under the feeding position in the twin screw extruder to melt the pellets and to forward the melt downstream to the injection position.

We have found that by using a twin screw extruder, mixing and reaction of the aromatic polyester melt with the lactone monomer having a drastic viscosity difference become feasible. Useful twin screw extruders are commercially available; however, the mixing elements and the element arrangement sequence thereof in the twin screw extruder needed for the present invention are critical and are described below. Preferred twin screw extruders are intermeshing twin screw extruders. A single screw extruder such as taught by U.S. Pat. No. 4,045,401 is not useful in the present invention because a single screw extruder does not provide the fast mixing, residence time, residence time distribution, melt agitation, and process control required for the present invention.

The initial extrusion temperature exceeds the melting point (as measured by Perkin-Elmer Differential Scanning Calorimeter (DSC) from the maxima of the endotherm resulting from scanning a 2 milligram sample at 20° C. per minute) of the aromatic polyester used. The melting points of the preferred aromatic polyesters are 250° C. for PET and 266° C. for PEN. The preferred initial extrusion zone temperature is at least about 30° C. above the aromatic polyester melting point. Thus, the preferred initial extrusion temperature for PET is at least about 280° C. while the preferred initial extrusion temperature for PEN is at least about 296° C.

Step (B) for making the block copolymer comprises injecting lactone monomer into the molten aromatic polyester from step (A). Preferably, a piston pump is used to inject the lactone monomer at a constant rate into the aromatic polyester melt.

Preferably, the lactone monomer is premixed with catalysts at room temperature. Commercially available catalysts may be used. Preferred catalysts are organometallics based on metals such as lithium, sodium, potassium, rubidium, cesium, magnesium, inorganic acid salts, oxides organic acid salts and alkoxides of calcium, barium, strontium, zinc, aluminum, titanium, cobalt, germanium, tin, lead, antimony, arsenic, cerium, boron cadmium and manganese; and their organometallic complexes. More preferred catalysts are organic acid salts and organometallic compounds of tin, aluminum, and titanium. The most preferred catalysts are tin diacylate, tin tetra acylate, dibutyltin oxide, dibutyltin dilaurate, tin octonate, tin tetra acetate, triisobutyl aluminum, aluminum acetylacetonate, aluminum isopropoxide, aluminum carboxylates, tetra butyl titanium, germanium dioxide, antimony trioxide, prophyrin and phthalocyanine complexes of these metal ions. Two or more catalyst types may be used in parallel. Preferably, the amount of catalyst used is about 0.01 to about 0.2 weight percent based on the combined weight of aromatic polyester and lactone monomer.

Step (C) for making the block copolymer comprises dispersing the injected lactone monomer into the aromatic polymer melt so that a uniform mixture forms in less than about thirty seconds and preferably, in less than about twenty seconds. The phrase "uniform mixture" as used herein means even distribution of the lactone monomer into the aromatic polyester melt. Preferably, distributive combing mixers are used to disperse the injected lactone monomer into the high melt viscosity aromatic polyester melt. This rapid uniform mixture formation results in uniform ring opening polymerization of lactone, uniform block copolymer product, and stable downstream process. Preferably, at least one forward distributive intermeshing combing mixer, at least one neutral distributive intermeshing combing mixer, and at least one reverse distributive intermeshing combing mixer are used to achieve the desired mixing.

Step (D) for making the block copolymer comprises reacting the uniform mixture resulting from step (C) at a temperature from about 250° C. to about 280° C. to form block copolymer in less than about four minutes. The mixture is forwarded further downstream into a reaction zone where turbulators, mixers, and conveying elements are assembled. Turbulators are used to continuously agitate the melt, increase extruder volume without sacrificing the throughput rate, and control the reaction time. The hydroxyl end group of the aromatic polyester initiates ring-open polymerization of lactone monomer under catalytic conditions to form lactone block at the end of the aromatic polyester. The melt is constantly agitated by the turbulators and mixing elements to homogenize the reaction. This short reaction time minimizes transesterification while ensuring complete reaction which means to polymerize the lactone monomer to form the block at the aromatic polyester chain end and complete consumption of the injected lactone monomer. To determine residence time and residence distribution time, we added colored pellets which served as a marker to the aromatic polyester pellets. The term "residence time" means the time period starting from the colored pellet addition to the strongest color appearance. The term "residence distribution time" means the time range starting from the color appearance and ending at color disappearance. As the residence distribution time decreases, product uniformity increases. The residence distribution time is preferably less than about three minutes and more preferably less than about one minute. Preferably, the degree of transesterification between aromatic polyester and lactone blocks is less than five weight percent of the combined material weight.

Preferably, the block copolymer melt is then in step (E) devolatilized under vacuum in the twin screw extruder to remove the residual lactone monomer. The devolatization element allows the formation of thin polymer melt film and high surface area for effective removal of volatiles.

Preferably, after the devolatization, ultraviolet absorbers, antioxidants, pigments, and other additives are then in step (F) injected and dispersed into the copolymer melt in the twin screw extruder by a piston pump or a gear pump at a constant rate. The forward distributive intermeshing combing mixers are used to homogenize the additives in the copolymer. The melt in the temperature range of about 240° C. to about 280° C. is then forwarded downstream to a melt metering pump for fiber spinning.

The PET-Polycaprolactone block copolymer ("PET-PCL") based seat belt in the present invention has significantly increased weatherability when stabilizing compounds such as at least one ultraviolet absorber compatible with said polyesters and/or hindered amine light stabilizer ("HALS") and/or at least one antioxidant is incorporated into the block copolymer melt.

The stabilizing compounds found particularly advantageous for PET-PCL are (1) about 0.1 to about 2.0 percent of at least one ultraviolet absorber compatible with said polyester based on the weight of the PET-PCL to which they are added, and/or (2) about 0.1 to about 2.0 percent by weight of at least one HALS compound, and/or (3) about 0.1 to about 2 percent by weight of at least one antioxidant compound. Preferably, PET-PCL is stabilized with about 0.2 to about 1.0 weight percent of at least one ultraviolet absorber and/or about 0.3 to about 0.7 weight percent of at least one HALS as disclosed herein.

Preferred ultraviolet absorbers are stabilizers based on benzophenones, benzotriazoles, triazines, and oxanilides. Two or more stabilizer types may be used in parallel. Examples of benzophenones useful in the present invention include, but are not limited to, 2,4-dihydroxybenzophenone; 2-hydroxy-4-methoxybenzophenone; 2-hydroxy-4-tert-butoxybenzophenone; 2-hydroxy-4-octoxybenzophenone; 2-hydroxy-4-dodecyloxybenzophenone; 2-hydroxy-4-stearoxybenzophenone; 2-hydroxy-4-phenoxybenzophenone; 2-hydroxy- 4-(β-hydroxyethoxy)benzophenone; 2-hydroxy-4-(2'-hydroxy-3'-acryloxy-propoxy)benzophenone; 2-hydroxy-4-(2'-hydroxy-3'-methacryloxypropoxy) benzophenone; 2,2'-dihydroxybenzophenone; 2,2'-dihydroxy-4-methoxybenzophenone; 2,2'-dihydroxy-4-butoxybenzophenone; 2,2'-dihydroxy-4-octoxybenzophenone; 2,2'-dihydroxy-4-octoxybenzophenone; 2,2'-dihydroxy-4-lauroxybenzophenone; 2,2',4,4'-tetrahydroxybenzophenone; 2,2',4-trihydroxy-4-methoxybenzophenone; 2-hydroxy-4-methoxy-4'-chlorobenzophenone; 2,2'-dihydroxy-4,4'-dimethoxybenzophenone; 2-hydroxy-4-methoxy-2'-methyl-4'-hydroxybenzophenone; 2-hydroxy-4-methoxy-4'-tert-butylbenzophenone; 2-hydroxy-4-methoxy-4'-methylbenzophenone; 2-hydroxy-4,4'-dimethoxybenzophenone; 2-hydroxy-4,4',2'-trimethoxybenzophenone, and the like.

Examples of benzotriazoles useful in the present invention include, but are not limited to, 2-(2'-hydroxy-5'-methylphenyl)benzotriazole; 2-(2'-hydroxy-3',5'-di-tert-butylphenyl)benzotriazole; 2-(2'-hydroxy-3',5'-di-tert-butylphenyl)-5-chlorobenzotriazole; 2-(2'-hydroxy-3',5'-di-tert-amylphenyl)benzotriazole; 2-(2'-hydroxy-3'-tert-butyl-5'-methylphenyl)-5-chlorobenzotriazole; 2-(2'-hydroxy-5'-tert-butylphenyl)benzotriazole; 2-(2'-hydroxy-3'-sec-butyl-5'-tert-butylphenyl)benzotriazole; 2-(2'-hydroxy-5-tert-octylphenyl)benzotriazole; 2-(2'-hydroxy-3'-(3",4",5",6"-tetrahydrophthalimidomethyl)-5'-methylphenyl) benzotriazole; 2-(2'-hydroxy-4'-benzoyloxyphenyl) benzotriazole; 2-(2'-hydroxy-4'-p-methylbenzoyloxyphenyl)benzotriazole; 2-(2'-hydroxy-4'-p-chlorobenzoyloxyphenyl)benzotriazole; 2-(2'-hydroxy-4'-p-benzoyloxyphenyl)-5-chlorobenzotriazole; 2-(2'-hydroxy-4'-p-methylbenzoyloxyphenyl)-5-chlorobenzotriazole; 2-(2H-benzotriazol-2-yl)-4,6-bis(1-methyl-1-phenylethyl)-phenol; and the like.

Examples of triazines useful in the present invention include, but are not limited to 2-(4,6-diphenyl-1,3,5-triazin-2-yl) -5-hexyloxy phenol; 2-[4,6-bis(2,4-dimethylphenyl-1,3,5-triazin-2-yl]-5-octyloxy phenol; and the like.

Examples of oxanilides useful in the present invention include, but are not limited to, 2-ethoxy-2'-ethyloxanilide; 5-tert-butyl-2-ethoxy-2'-ethyloxanilide; propanedioic acid, [(4-methoxyphenyl)-methylene]-, bis (1,2,2,6,6-pentamethyl-4-piperidinyl) ester, and the like. Two or more ultraviolet absorber types may be used in parallel.

The HALS useful in the present invention are based on hindered amine compounds. Examples of these include, but are not limited to 1,1'-[1,2-ethanediyl]-bis[3,3,5,5-tetramethylpiperazinone]; dimethylsuccinate polymer with 4-hydroxy-2,2,6,6-tetramethyl-1-piperdineethane; bis(1,2,2,6,6-pentamethyl-4-piperidinyl)-sebacate; bis[2,2,6,6-tetramethyl-4-piperidinyl]decanedioate; bis(1,2,2,6,6-pentamethyl-4-piperidinyl)-2-[[3,5-bis(1,1-dimethylethyl)-4-hydroxyphenyl]methyl]-2-butylpropanedioate; poly[(2,2,6,6-tetramethyl-4-piperidinyl)iminomethylene(2,2,6,6-tetramethyl-4-piperadinyl)imino[6(octylamino)-1,3,5-triazine-4,2-diyl]]; 2,2,6,6-tetramethyl-4-piperidinyl benzoate; tetrakis(2,2,6,6-tetramethyl-4-piperidinyloxy) silane; 1,6-hexanediamine, N,N'-bis(2,2,6,6-tetramethyl-4'-piperidinyl)-polymer with morpholine-2,4,6-trichloro-1,3,5-triazine; poly [6(-morpholino-s-triazine-2,4,diyl)[2,2,6,6-tetramethyl-4-piperidyl)imino]-hexamethylene[(2,2,6,6-tetramethyl-4-piperidyl)imino]], and the like. Two or more HALS types may be used in parallel.

The antioxidants useful in the present invention are those which are generally compatible with polyester. Preferred antioxidants are additives based on hindered phenolics, hindered benzoates, hinder amines, and phosphites/phosphonites. Examples of these include, but are not limited to, tetrakis[methylene(3,5-di-tert-butyl-4-hydroxyhydrocinnamate)]methane; triethyleneglycol bis[3-(3'-tert-butyl-4'-hydroxy-5'-methylphenyl) propionate]; and tris(2,4-di-tert-butylphenyl) phosphite. Two or more additive types may be used in parallel.

The use of UV absorbers, HALS, and antioxidants improves the light fastness of the seat belt by at least one gray scale rating and prevents the degradation of the seat belt load limiting performance.

The uniform melt is then fed into a spin pot which contains a filtration screen and a spinnerette. The extrudated filaments are pulled through a heated sleeve, quenched by ambient air, applied with water soluble spin finish, and taken by godet at a certain speed. The as-spun yarn is then fully drawn with a high draw ratio to obtain its maximum strength. The relaxation stage shrinks the yarn and produces the yarn with the desired stress-strain curve shown in FIG. 3.

The resulting yarn has a force-displacement profile characterized by:

a) when the yarn is subjected to an initial stress barrier of from about 0.8 gram/denier to less than or equal to about 1.2 grams/denier, the yarn elongates to less than 5 percent and has an initial modulus in the range from about 30 grams/denier to about 80 grams/denier; the yarn elongates to less than 5 percent and has an initial modulus in the range from about 30 grams/denier to about 80 grams/denier;

b) upon subjecting the yarn to greater than said initial stress barrier and to less than or equal to about 1.5 grams/denier, the yarn elongates further to at least about 8 percent; and c) upon subjecting the yarn to greater than 1.5 grams/denier, the modulus increases sharply and the yarn elongates further until the yarn breaks at a tensile strength of at least 6 grams/denier wherein the yarn comprises a multiplicity of fibers and all of the fibers have substantially the same force-displacement profile. The resulting yarn may be used directly for weaving into finished seat belt.

Seat belts are usually woven with at least 300 ends of warp yarn with a denier of about 800 to about 2,000 and preferably about 1,000 to about 1,500 denier, a breaking strength of at least about 6 grams/denier, and a filament denier of about 2 to about 30, and one end of weft yarn with a denier of about 200 to about 1,000, a breaking strength of at least about 5 grams/denier, and a filament denier of about 1 to about 1,000. Each end of warp yarn may consist of about 100 filaments. The denier of weft yarn and/or the denier of filament in weft yarn may be varied to improve the lateral stiffness of the webbing. Weaving patterns are normally selected to meet the different customer specifications. One of the commonly used patterns is 2×2 twill. It is also important in the weaving process to preserve the elastic properties and the strength of the yarn to achieve load limiting webbing with the breaking strength meeting government specification.

The present process for making load limiting webbing comprises the step of:

heating the webbing at a temperature from about 120° C. to about 180° C. under sufficient tension or shrinkage so to achieve the treated webbing which has a force-displacement profile characterized by:

i) when the webbing is subjected to a knuckle point force in the range from about 400 pounds (about 1.8 kilonewtons) to about 900 pounds (about 4.0 kilonewtons), the webbing elongates to less than about five percent;

ii) upon subjecting the webbing to greater than the knuckle point force and to less or equal to about 1,400 pounds (about 6.2 kilonewtons), the webbing elongates further to at least about ten percent; and iii) upon subjecting the webbing to greater than 1,400 pounds (about 6.2 kilonewtons), the modulus increases sharply and the webbing elongates further until the webbing breaks at a tensile strength of at least about 5,000 pounds (about 22 kilonewtons).

Depending upon the desired final webbing properties, the webbing heated at a temperature from about 120° C. to about 180° C. may be stretched, relaxed, or not stretched or relaxed. In order for the webbing to be stretched, the speed of the roller feeding the webbing into thermosol is less than the speed of the roller receiving the webbing from the thermosol. For stretching, the speed of the roller receiving the webbing from the thermosol is preferably less than or equal to 20 percent, more preferably less than or equal to 10 percent, and most preferably less than or equal to 5 percent greater than the speed of the roller feeding the webbing into the thermosol. In order for the webbing to be relaxed, the speed of the roller feeding the webbing into thermosol is greater than the speed of the roller receiving the webbing from the thermosol. For relaxation, the speed of the roller feeding the webbing into the thermosol is preferably less than or equal to 20 percent, more preferably less than or equal to 10 percent, and most preferably less than or equal to 5 percent greater than the speed of the roller receiving the webbing from the thermosol.

Preferably, the present process for making load limiting webbing comprises dyeing the webbing. Preferably, the process additionally comprises the step of: prior to the heat treatment of the webbing, scouring the webbing and/or padding the webbing in a dye bath. Preferably, the process additionally comprises the step of: after the padding and before the heat treatment, drying the padded webbing at a temperature range from about 60° C. to about 170° C.

Preferably, the greige load limiting seat belt webbing is dipped into an aqueous dye bath which contains disperse dyes, dispersing agent/leveling agent, wetting agent, anti-migrating agent, and acid donor to maintain pH of the bath at 4.8–5.0. The dye bath may also contain disperse ultra-violet absorbers, antioxidants, and other additives to further improve seat belt light fastness and preserve load limiting properties of seat belts with time. As previously discussed, ultraviolet absorbers, HALS, and antioxidants may be injected into the polymer melt in the extrusion process and incorporated directly into the spun fiber. These additives may also be dispersed in the dyebath and subsequently applied to the seat belt webbing in the dyeing process. The same types of UV absorbers, HALS, and antioxidants described above for possible incorporation into the fiber may be used in the bath. Functional groups may be added to these compounds to obtain good dispersion in the dyebath. Although unnecessary in the present invention, the dye bath may also contain dye carrier to swell the fiber, increase permeability of the fiber, and facilitate the diffusion of the dye and additive molecules into the fiber.

Examples of preferred disperse dyes include anthraquinone dyes; azo dyes; nitrodiphenylamine dyes; methine dyes; quinophthalone dyes; and naphthoquinone dyes. Disperse dyestuffs commonly used are dyes with Color Index Red 72; Red 73; Red 82; Red 86; Red 91; Red 167; Red 177; Red 302; Orange 29; Orange 30; Orange 37; Orange 41; Orange 44; Yellow 42; Yellow 42/Yellow 86; Blue 27; Blue 60; Blue 64; Blue 73; Blue 77; Blue 79; Blue 87/Blue 77; and Blue 165. The combinations of different dyestuffs at proper ratio may be used to give desired color shades for automotive seat belt. Other preferred dyes may include reactive dyes and pigments.

Examples of preferred dispersing/leveling agents include ethoxylated dioctyl phenol, sodium lignosulfonate, other anionic and nonionic surface active agents and the mixture of those.

Examples of preferred wetting agents include polyglycol ether, sulfuric acid ester salt, alkyl alcohol polyglycol ether, and other surfactants.

Examples of preferred antimigrant agents include linear polymeric anhydride and other agents.

Examples of dye carriers include chlorinated benzene; di-phenyl; benzoic acid; salicyclic acid; o-phenylphenol; dimethyl terephthalate; and phthalamides.

The webbing with about 25% to about 35% wet pickup is then pulled into a predrier set at a temperature between about 60° C. to about 170° C. and the water on the webbing is removed. The dye and additive particles are deposited on the surface of the fiber. The dried webbing is then moved into thermosol chamber set at a temperature between about 120° C. to about 180° C. where disperse dyes, UV absorbers, and other stabilizers are diffused into fiber by heat. The thermosol temperature, webbing tension, and thermosol residence time are the important parameters to control dye and/or chemical diffusion and dyeing uniformity. The residence time of webbing in the predrier and thermosol is preferably less than about 4 minutes. The brake unit located between the predrier and thermosol chambers and haul unit located after thermosol chamber are used to control the tension of webbing inside the thermosol to further tailor the stress-strain curve of seat belt by thermal relaxation or elongation of the webbing. The preferred tension is adjusted by the difference in the entry and exit speeds of the webbing in the thermosol. A brake unit may be used to control the feeding speed.

The dyed seat belt is then pulled into a cleaning pad to remove residual dyes and/or chemicals from the surface of webbing. The dyed seat belt is pulled into a steamer to fix the remaining unfixed dyestuff and moved into wash boxes to remove residual dyes and/or chemicals from the surface of webbing. The dyed and washed webbing is dried, and an overfinish is coated onto the webbing to improve abrasion properties and lateral stiffness of load limiting seat belt.

The finished load limiting webbing has a force-displacement profile illustrated in FIG. 2 characterized by:

a) when the webbing is subjected to a knuckle point force in the range from about 400 pounds (about 1.8 kilonewtons) to about 900 pounds (about 4.0 kilonewtons), the webbing elongates to less than about five percent;

b) upon subjecting the webbing to greater than the knuckle point force less than or equal to about 1,400 pounds (about 6.2 kilonewtons), the webbing elongates further to at least about ten percent; and c) upon subjecting the webbing to greater than 1,400 pounds (about 6.2 kilonewtons), the modulus increases sharply and the webbing elongates further until the webbing breaks at a tensile strength of at least about 5,000 pounds (about 22 kilonewtons).

The automotive collision tests of this type of load limiting seat belt webbing show that the force against occupant is reduced and injury criteria are minimized.

The present web is useful for seat belts, parachute harnesses and lines, shoulder harnesses, cargo handling, safety nets, trampolines, safety belts or harnesses for workers at high attitudes, military arrestor tapes for slowing aircraft, ski tow lines, and in cordage applications such as for yacht mooring or oil derrick mooring.

TEST METHODS

In the following Examples, the reduced specific viscosity was determined as follows. Solution viscosity and solvent viscosity were measured and specific viscosity was calculated by (solution viscosity-solvent viscosity)/(solvent viscosity). Reduced specific viscosity was calculated from specific viscosity/solution concentration.

The intrinsic viscosity of polymer was determined by plotting the reduced specific viscosity of polymer solution versus solution concentration in a mixed solvent of 60 parts of phenol and 40 parts of tetrachloroethane at 25° C. The intercept was the intrinsic viscosity of polymer. It is understood that IV is expressed in units of deciliters per gram or (dl/g) herein even if such units are not indicated.

Thermal properties were measured by Perkin Elmer Differential Scanning Calorimetry-7 using a polymer chip sample size of about five milligrams, heating the sample to 285° C. at the rate of 10° C./minute, holding the sample at 285° C. for two minutes, and cooling the sample to 30° C. at the rate of 10° C./minute. The peak temperature of endotherm in heating scan was the melting point of a polymer and the peak temperature of exotherm in cooling scan was the crystallization temperature of a polymer. The glass transition temperature of a polymer was the second order thermal transition temperature during both heating and cooling scans.

For the preferred yarn made of block copolymer, the Newtonian melt viscosity for the starting PET of the Inventive Example was calculated to be at least 7,000 poise at 280° C. based on Andrzej Ziabicki, "Effects of Molecular Weight on Melt Spinning and Mechanical Properties of High-Performance Poly(ethylene Terephthalate) Fibers", *Textile Res. J.* 66(11), 705–712 (1996) and A. Dutta, "Identifying Critical Process Variables in Poly(ethylene Terephthalate) Melt Spinning", *Textile Res. J.* 54, 35–42 (1984). The Newtonian melt viscosity means the melt viscosity at zero shear rate.

Melt viscosity of block copolymer under various spinning conditions was extrapolated from melt rheology data obtained from Kayeness Galaxy V capillary rheometer with capillary die L/D=30:1 using shear rates ranging from 50/sec to 998/sec. The samples were dried at 160° C. for 16 hour under vacuum before measurement. 15 gram of sample was packed into the rheometer and allowed to melt to reach temperature equilibrium for 6 minutes before beginning melt viscosity measurements. Runs under different temperature were made at constant shear rate over a range of shear rates including 50 $sec^{-1}$, 100 $sec^{-1}$, 200 $sec^{-1}$, 499 $sec^{-1}$, and 998 $sec^{-1}$ and at times up to 20 minutes. No corrections were made for end effects so values are apparent melt viscosities.

Tensile properties of the webbing were measured on an Instron machine equipped with pneumatic cord and webbing grips which hold the webbing at the gauge length of four inches. The webbing was then pulled by the strain rate of four inches/minute under standard conditions (23±2° C., 50%±5% relative humidity) and the data was recorded by a load cell and extensiometer. From this data, the stress-strain curves were obtained.

For lightfastness, load limiting seat belt samples were cut and mounted on 2.5"×6" cards and placed in Xenon arc WeatherOmeter. The samples were exposed to various amount of controlled radiation, specified in SAE J1885 (87). The reflectances of the control (unexposed) sample and exposed sample were measured with spectrophotometer. The color difference between the control and exposed samples were calculated as Delta E or graded with Gray Scale. Note that for Delta E readings, lower numbers were indicative of better dye light fastness; while with Gray Scale, higher numbers were indicative of better dye light fastness.

For dynamic sled test, an average sized dummy was restrained with seat belt webbing and fully instrumented in a compact vehicle. The sled test was conducted at a speed of 40 miles per hour and pulse rate of 28 g (which is the acceleration of gravity). The movement of the dummy and injury criteria were recorded by sensors and high speed cameras.

INVENTIVE EXAMPLE 1

Figure 3:
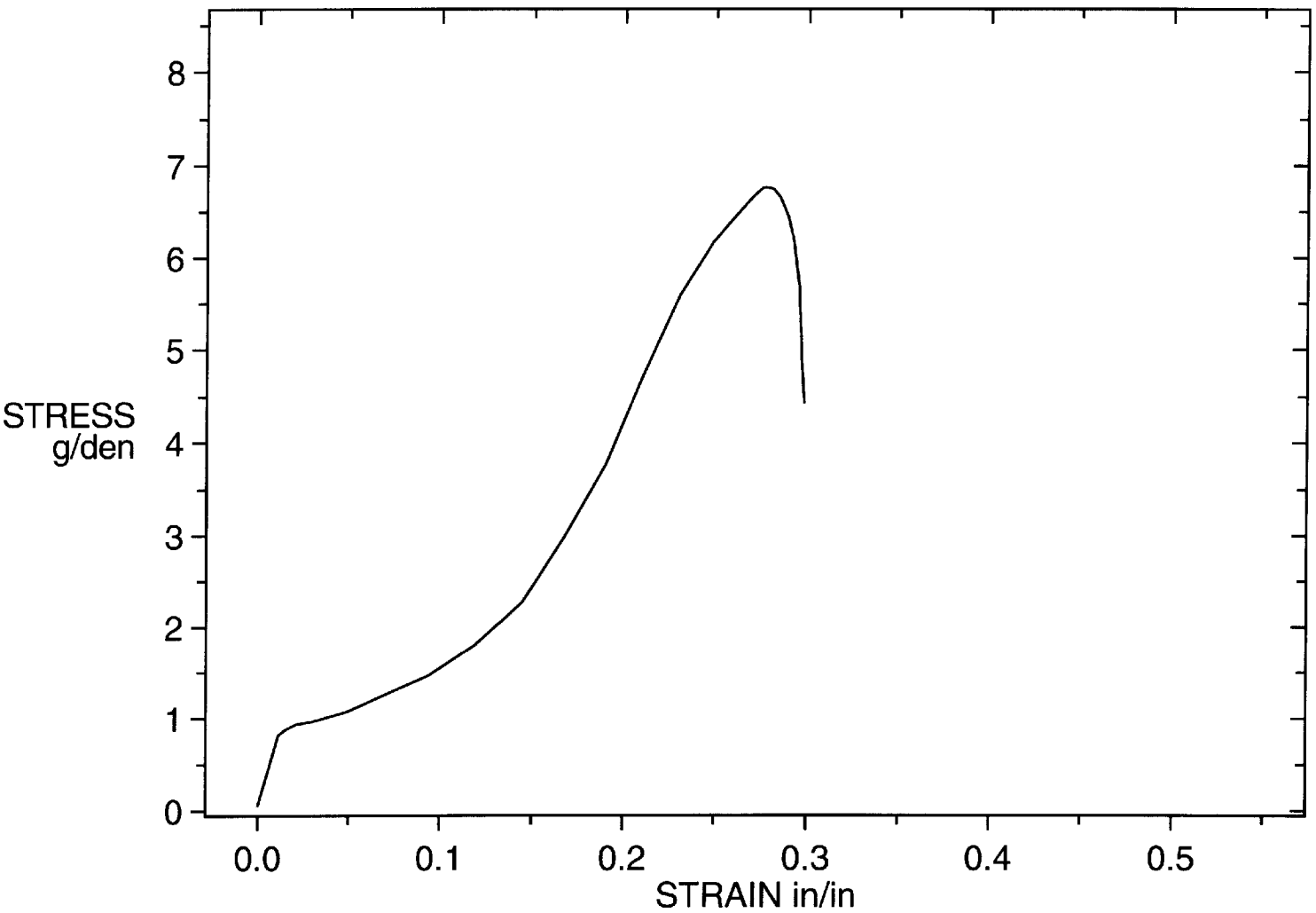
FIG. 3 illustrates a stress-strain curve of the yarn useful in the present invention.

PET-Polycaprolactone block copolymer (weight ratio of 85:15) was spun into the yarn having the characteristics of a stress-strain curve in FIG. 3. Each end of warp yarn consisted of one hundred filaments having 13 denier per filament. 342 ends of warp yarn were beamed and woven with one end of 650 denier weft yarn having 13 denier per filament into seat belt under a five panel 2×2 twill weaving pattern to form a greige seat belt webbing.

Figure 4:
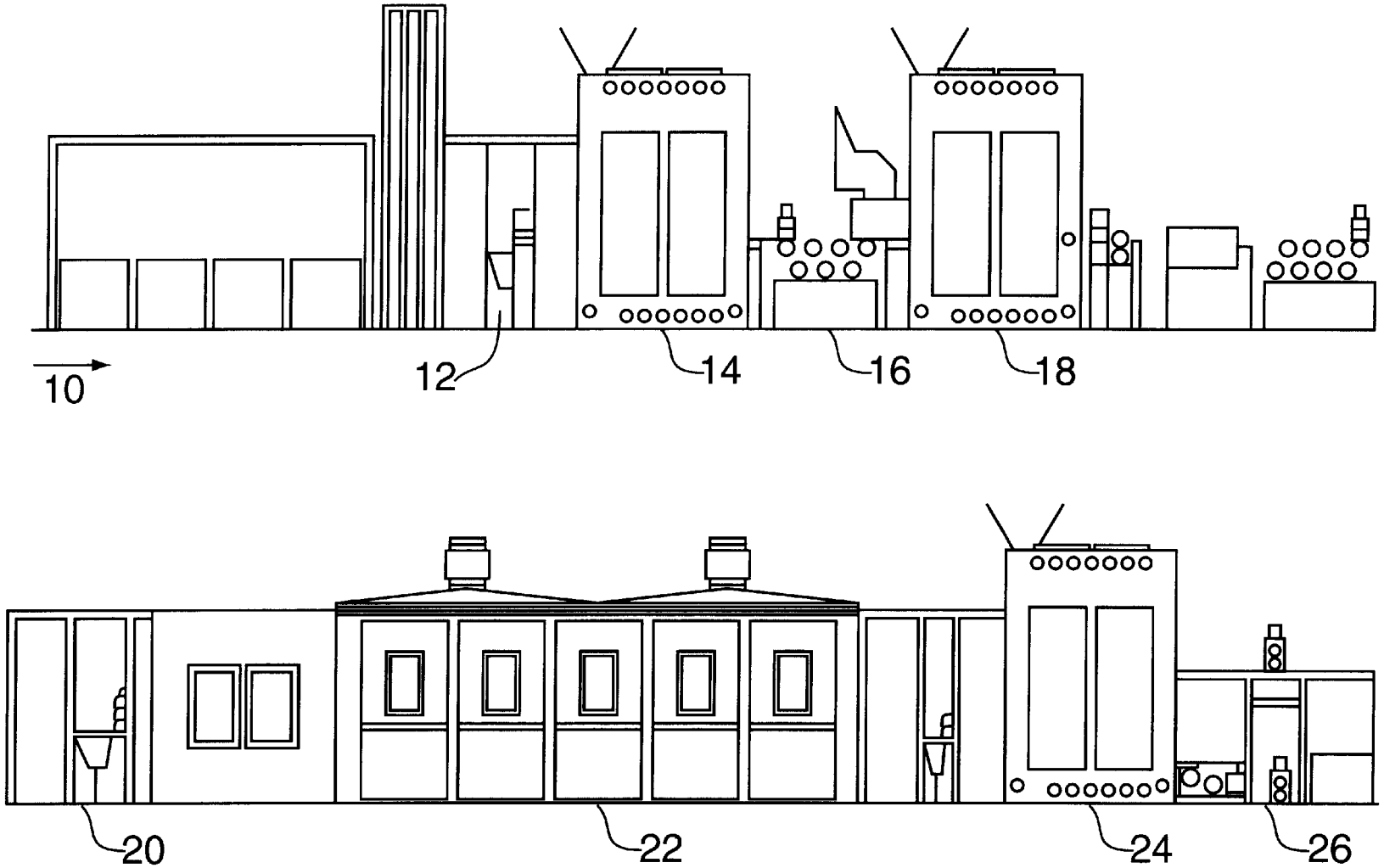
FIG. 4 illustrates the webbing dyeing process of the present invention.
Figure 5A:
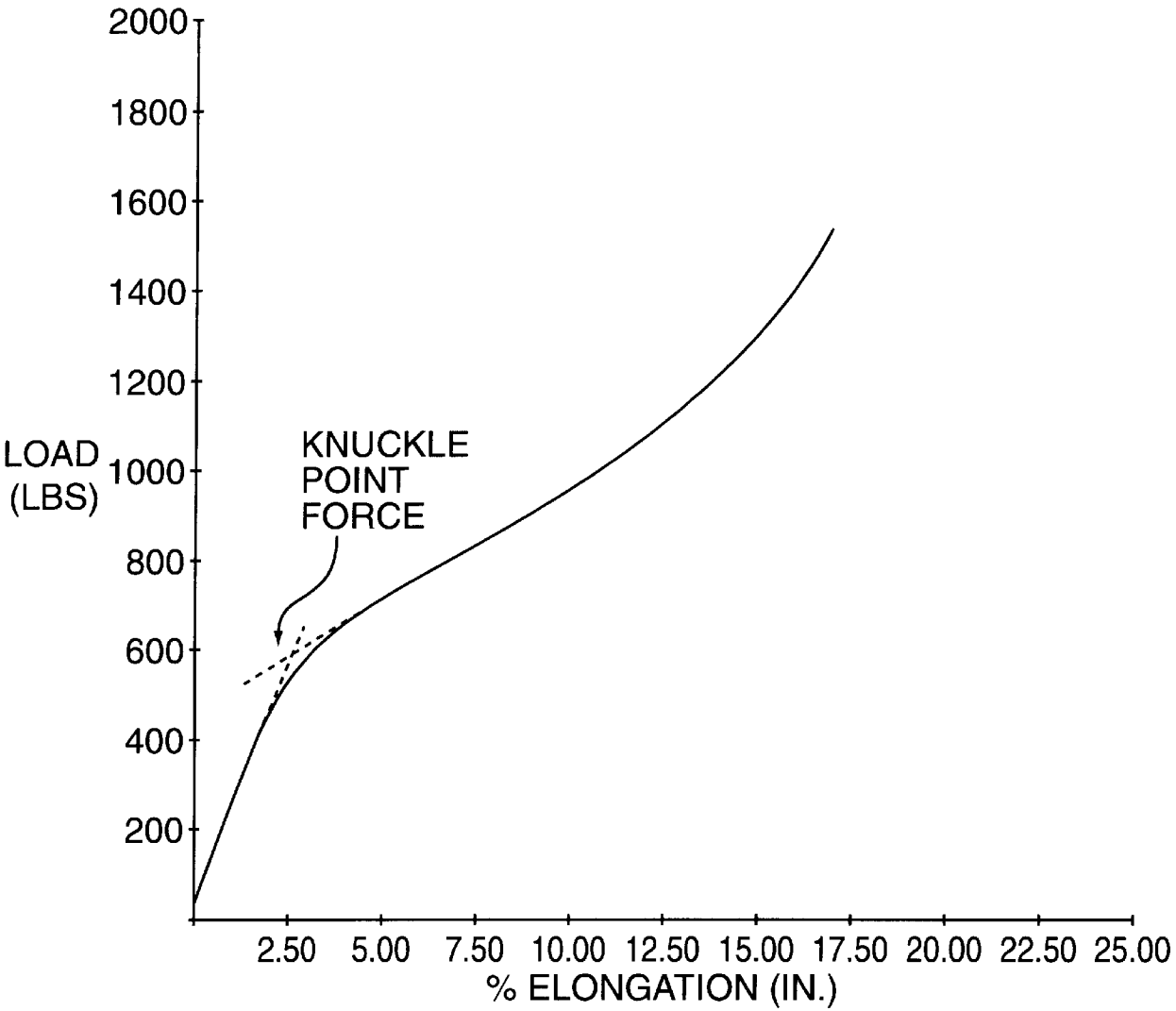
FIGS. 5(*a*), (*b*), (*c*), and (*d*) illustrate stress-strain curves of Inventive Examples 1 through 4.
Figure 5B:
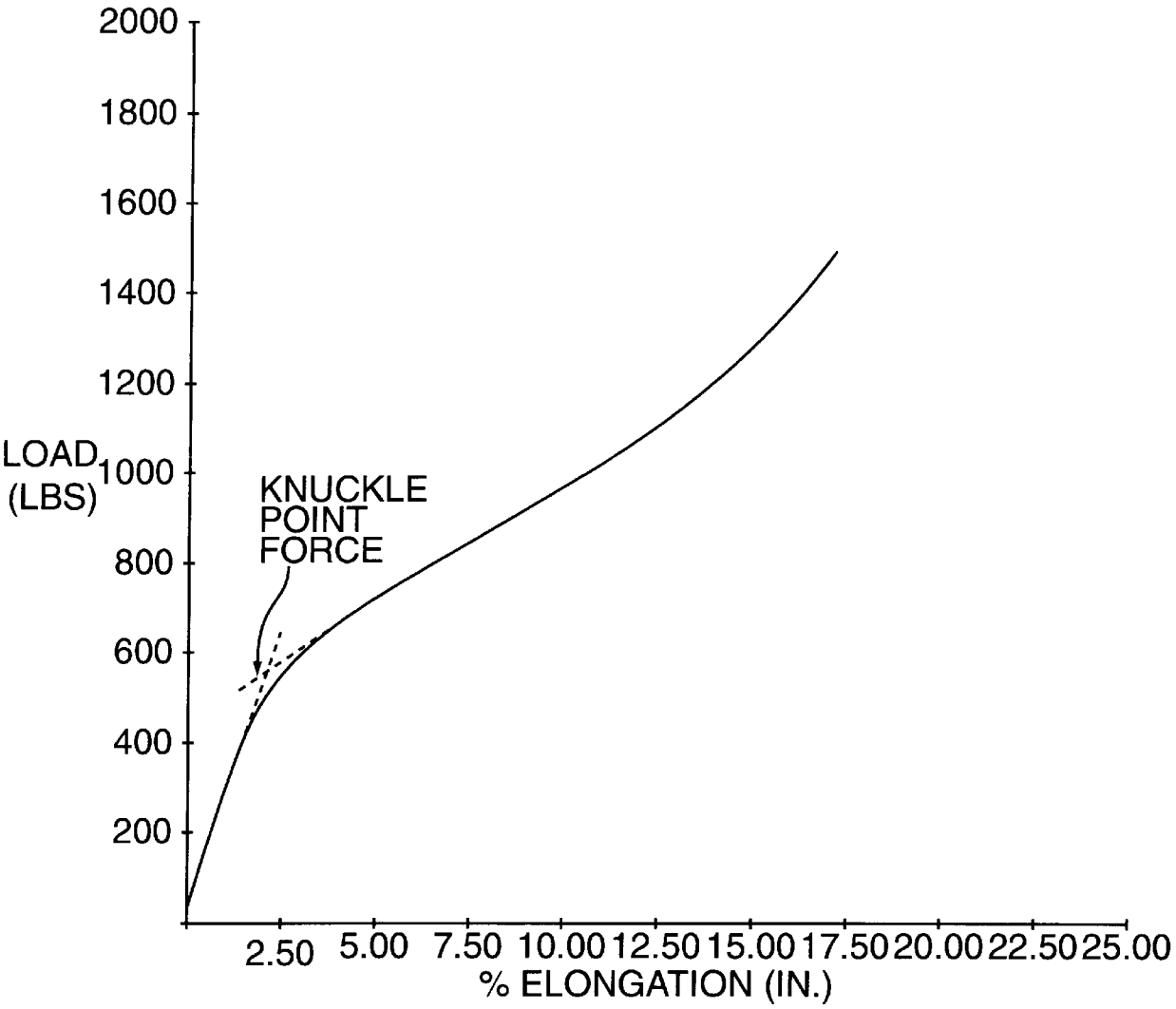
Figure 5C:
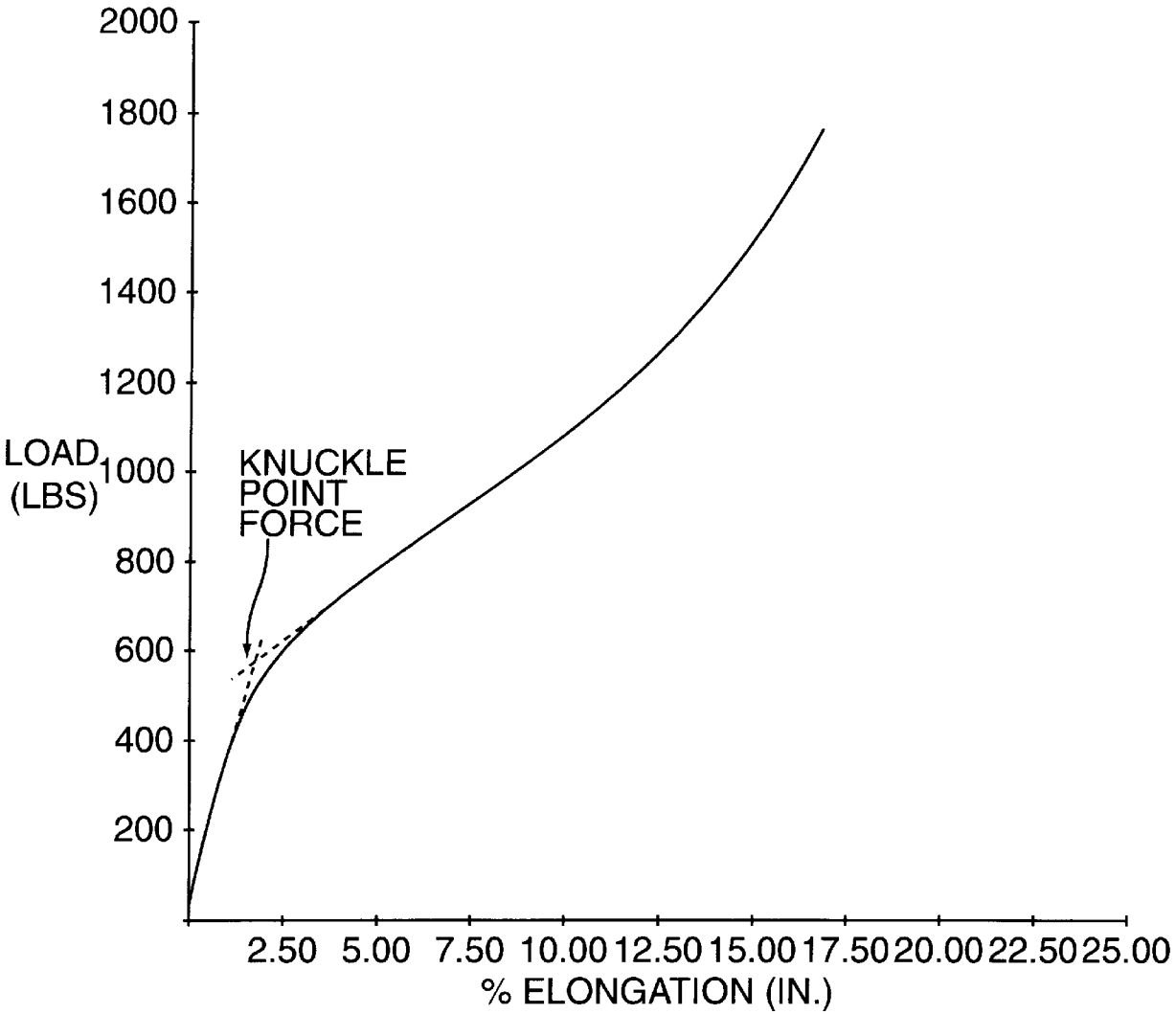
Figure 5D:
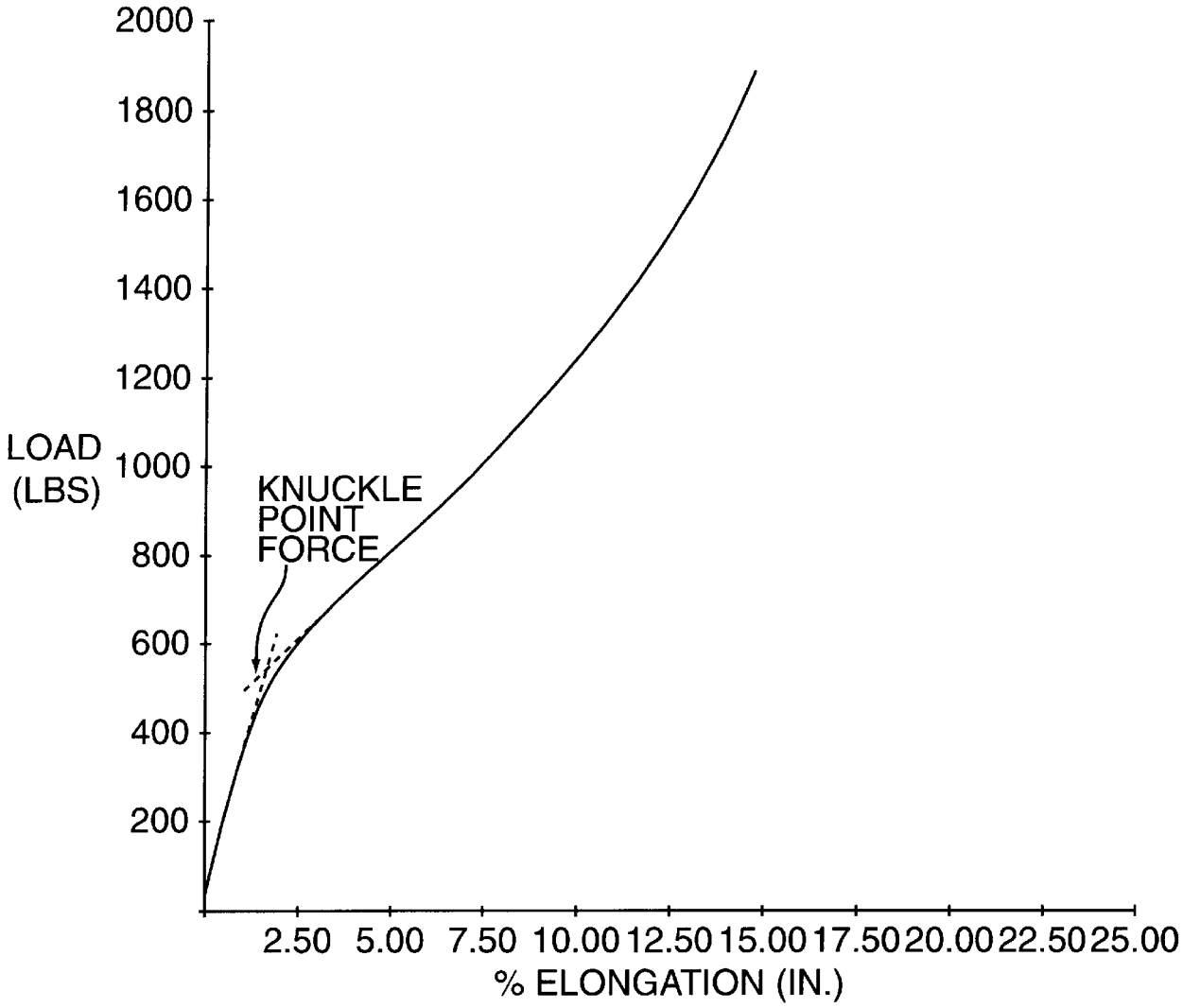

Referring to FIG. 4, the webbing moved in the direction of arrow 10. The greige seat belt webbing was padded in the disperse dyebath described above. The dye was applied from a dye bath 12 via a single dip/single squeeze process and the webbing was then passed through an air convection predrier 14 set at a temperature of 120° C. with a residence time of 2.4 minutes. The predried, dyestuff-coated webbing was then passed through a rubber pinch braking roller 16 and into convection thermosol oven 18 heated at 120° C. to diffuse dye into the webbing. The webbing residence time in the thermosol oven 18 was 2.4 minutes with the webbing under no tension. The dyed web therein was then neutralized in a clearing bath 20 of 2 grams/liter sodium hydrosulfite at 27° C., washed with detergent in two separate baths 22 at 96–100° C., rinsed with hot water at 96–100° C., and then rinsed in a cold solution of 5 grams/liter acetic acid (PH 4.5–5.0). The webbing was then coated with an overfinish and dried by passing over steam cans 24. The webbing was taken up at 26 for tensile testing.

The results are shown in FIG. 5(*a*) which indicates that the webbing has a force-displacement profile characterized by: (*a*) when the webbing is subjected to a knuckle point force of about 580 pounds (about 2.6 kilonewtons), the webbing elongates to less than about 2.5 percent; (b) upon subjecting the webbing to greater than said knuckle point force and to less or equal to about 1,400 pounds (about 6.2 kilonewtons), the webbing elongates further to at least about 15.5 percent; and (c) upon subjecting the webbing to greater than 1,400 pounds (about 6.2 kilonewtons), the modulus increases sharply and the webbing elongates further until said webbing breaks at a tensile strength of at least about 5,073 pounds (about 22.6 kilonewtons). FIG. 5(*a*) does not show the tensile breaking strength.

INVENTIVE EXAMPLE 2

In this example, a PET-Polycaprolactone seat belt webbing was woven and fully dyed in accordance with the procedure set forth in Inventive Example 1 except that the predrier and thermosol ovens were set at a temperature of 130° C. The webbing was taken up for tensile testing. The results are shown in FIG. 5(*b*) which indicates that the webbing has a force-displacement profile characterized by: (a) when the webbing is subjected to a knuckle point force of about 540 pounds (about 2.4 kilonewtons), the webbing elongates to less than about two percent; (b) upon subjecting the webbing to greater than said knuckle point force and to less or equal to about 1,400 pounds (about 6.2 kilonewtons), the webbing elongates further to at least about 16 percent; and (c) upon subjecting the webbing to greater than 1,400 pounds (about 6.2 kilonewtons), the modulus increases sharply and the webbing elongates further until said webbing breaks at a tensile strength of at least about 5,210 pounds (about 23.2 kilonewtons). FIG. 5(*b*) does not show the tensile breaking strength.

INVENTIVE EXAMPLE 3

In this example, a PET-Polycaprolactone seat belt webbing was woven and fully dyed in accordance with the procedure set forth in Inventive Example 1 except that the predrier and thermosol ovens were set at a temperature of 140° C. The webbing was taken up for tensile and dynamic testing. The results are shown in FIG. 5(*c*) which indicates that the webbing has a force-displacement profile characterized by: (a) when the webbing is subjected to a knuckle point force of about 580 pounds (about 2.6 kilonewtons), the webbing elongates to less than about two percent; (b) upon subjecting the webbing to greater than the knuckle point force and to less or equal to about 1,400 pounds (about 6.2 kilonewtons), the webbing elongates further to at least about 13 percent; and (c) upon subjecting the webbing to greater than 1,400 pounds (about 6.2 kilonewtons), the modulus increases sharply and the webbing elongates further until the webbing breaks at a tensile strength of at least about 5,100 pounds (about 22.7 kilonewtons). FIG. 5(*c*) does not show the tensile breaking strength.

INVENTIVE EXAMPLE 4

In this example, a PET-Polycaprolactone seat belt webbing was woven and fully dyed in accordance with the procedure set forth in Inventive Example 1 except that the predrier and thermosol ovens were set at a temperature of 140° C. and the webbing in the thermosol oven was under a net stretch of about 3%. The webbing was taken up for tensile testing. The results are shown in FIG. 5(*d*) which indicates that the webbing has a force-displacement profile characterized by: (a) when the webbing is subjected to a knuckle point force of about 560 pounds (about 2.5 kilonewtons), the webbing elongates to less than about two percent; (b) upon subjecting the webbing to greater than said knuckle point force and to less or equal to about 1,400 pounds (about 6.2 kilonewtons), the webbing elongates further to at least about 12 percent; and (c) upon subjecting the webbing to greater than 1,400 pounds (about 6.2 kilonewtons), the modulus increases sharply and the webbing elongates further until said webbing breaks at a tensile strength of at least about 5,073 pounds (about 22.6 kilonewtons). FIG. 5(*d*) does not show the tensile breaking strength.

INVENTIVE EXAMPLE 5

The PET-Polycaprolactone yarn used in Inventive Example 1 was knitted into sleeve and the greige PET-Polycaprolactone sleeve was padded in the disperse dyebath described above. The dye was applied from a dye bath via a single dip/single squeeze process and the sleeve was then mounted on a frame under tension and moved into an air convection predrier set at a temperature of 130° C. with a residence time of 3 minutes. The predried, dyestuff-coated sleeve was then moved into another air convection oven heated at 150° C. to diffuse dye into the PET-Polycaprolactone filaments of the sleeve. The sleeve residence time in this oven was 3 minutes. The dyed sleeve therein was then neutralized in a clearing bath of 2 grams/liter sodium hydrosulfite at 27° C., steamed and washed with detergent at 96–100° C., rinsed with hot water at 96–100° C., and then rinsed in a cold solution of 5 grams/liter acetic acid (PH 4.5–5.0). The sleeve was then dried and taken up for light fastness studies. Under the testing standards of SAE J1885, GS Rating (225KJ)=1.5, GS Rating (488KJ)=1.

INVENTIVE EXAMPLE 6

In this example, yarn was spun from PET-Polycaprolactone (weight ratio of 85:15) block copolymer blended with 2-(2'-hydroxy-4'-methoxyphenyl)-4,6-diphenyl-triazine at one weight percent of PET-Polycaprolactone copolymer. A sleeve was knitted from the yarn and fully dyed in accordance with the procedure set forth in Inventive Example 5. The dyed sleeve was taken up for light fastness studies. Under the testing standards of SAE J1885, GS Rating (225KJ)=3.5, GS Rating (488KJ)=2.0.

INVENTIVE EXAMPLE 7

In this example, yarn was spun from PET-Polycaprolactone (weight ratio of 85:15) block copolymer blended with 2-ethoxy-2'-ethyloxanilide at one weight percent of PET-Polycaprolactone copolymer. A sleeve was knitted from the yarn and fully dyed in accordance with the procedure set forth in Inventive Example 5. The dyed sleeve was taken up for light fastness studies. Under the testing standards of SAE J1885, GS Rating (225KJ)=3.5, GS Rating (488KJ)=1.5.

INVENTIVE EXAMPLE 8

In this example, yarn was spun from PET-Polycaprolactone (weight ratio of 85:15) block copolymer blended with propanedioic acid, [(4-methoxyphenyl)-methylene]-, bis (1,2,2,6,6-pentamethyl-4-piperidinyl) ester at one weight percent of PET-Polycaprolactone copolymer. A sleeve was knitted from the yarn and fully dyed in accordance with the procedure set forth in Inventive Example 5. The dyed sleeve was taken up for light fastness studies. Under the testing standards of SAE J1885, GS Rating (225KJ)=3.5, GS Rating (488KJ)=2.0.

INVENTIVE EXAMPLE 9

In this example, yarn was spun from PET-Polycaprolactone (weight ratio of 85:15) copolymer blended with poly [(6-morpholino-s-triazine-2,4,diyl) [2,2,6,6-tetramethyl-4-piperidyl) imino]-hexamethylene[(2,2,6,6-tetramethyl-4-piperidyl) imino]] at one weight percent of PET-Polycaprolactone copolymer. A sleeve was knitted from the yarn and fully dyed in accordance with the procedure set forth in Inventive Example 5. The dyed sleeve was taken up for light fastness studies. Under the testing standards of SAE J1885, GS Rating (225KJ)=3.0, GS Rating (488KJ)=2.0.

INVENTIVE EXAMPLE 10

In this example, yarn was spun from PET-Polycaprolactone (weight ratio: 85:15) copolymer blended with 2-[4,6-Bis(2,4-dimethylphenyl)-1,3,5-triazin-2-yl]-5-(octyloxy) phenol and 1,6-Hexanediamine, N,N'-bis(2,2,6,6-tetramethyl-4-piperidinyl)-, Polymers with morpholine-2,4,6-trichloro-1,3,5-triazine at one half of weight percent of PET-Polycaprolactone copolymer, respectively. A sleeve was knitted from the yarn and fully dyed in accordance with the procedure set forth in Inventive Example 5. The dyed sleeve was taken up for light fastness studies. Under the testing standards of SAE J1885, GS Rating (225KJ)=3.0, GS Rating (488KJ)=2.0.

INVENTIVE EXAMPLE 11

PET-Polycaprolactone yarn used in Inventive Example 1 was knitted into sleeve and the disperse dye liquor described above with the addition of 10 g/liter of dye carrier was padded onto the greige PET-Polycaprolactone sleeve. The dye was applied from a dye bath via a single dip/single squeeze process and the sleeve was then mounted on a frame and moved into an air convention predrier set at a temperature of 130° C. with a residence time of 3 minutes. The predried, dyestuff-coated sleeve under tension was then moved into another air convection oven heated at 150° C. to diffuse dye into the PET-Polycaprolactone filaments of the sleeve. The sleeve residence time in the thermosol oven was 3 minutes. The dyed sleeve therein was then neutralized in a clearing bath of 2 grams/liter sodium hydrosulfite at 27° C., steamed and washed with detergent at 96–100° C., rinsed with hot water at 96–100° C., and then rinsed in a cold solution of 5 grams/liter acetic acid (PH 4.5–5.0). The sleeve was then dried and taken up for light fastness studies. Under the testing standards of SAE J1885, GS Rating (225KJ)=3.0, GS Rating (488KJ)=1.0.

INVENTIVE EXAMPLE 12

In this example, PET-Polycaprolactone yarn used in Inventive Example 1 was knitted into sleeve. The disperse dyebath described above with the addition of 10 g/liter of dye carrier and 60 g/liter of Cibafast P was padded onto the greige PET-Polycaprolactone sleeve. The sleeve was fully dyed in accordance with the procedure set forth in Inventive Example 8. The dyed sleeve was taken up for light fastness studies. Under the testing standards of SAE J1885, GS Rating (225KJ)=4, GS Rating (488KJ)=2.5.

INVENTIVE EXAMPLE 13

Figure 6:
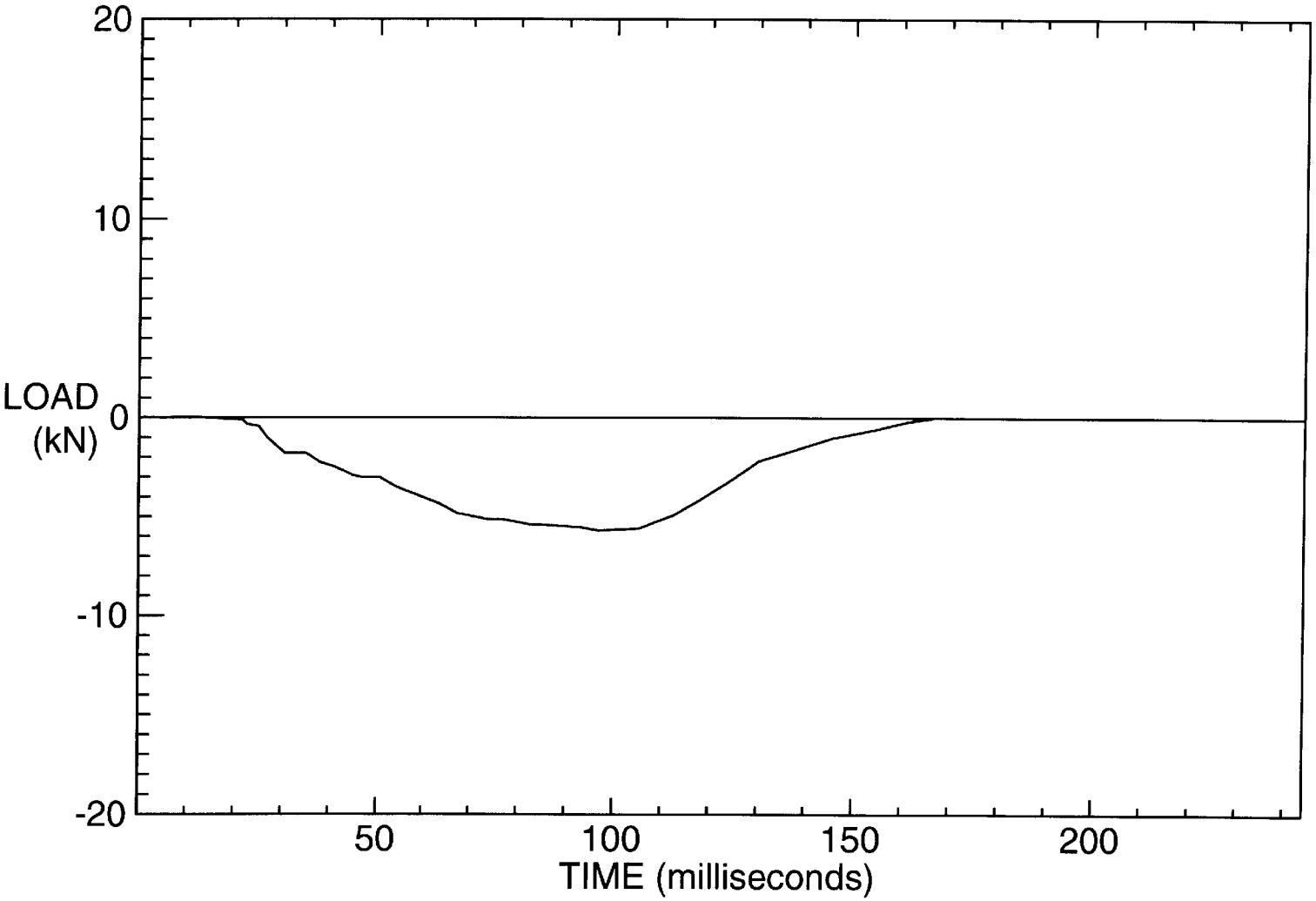
FIG. 6 illustrates the performance (with load as a function of time) of the load limiting webbing of the present invention at the torson position in a vehicle collision.

In the sled test, the average sized dummy was restrained with seat belt webbing in Inventive Example 3 and fully instrumented in a compact vehicle. The sled test was conducted at a speed of 40 miles per hour and pulse rate of 28 g (which is the acceleration of gravity). The movement of the dummy and injury criteria were recorded by sensors and high speed cameras. FIG. 6 illustrates the performance (with load as a function of time) of the present load limiting seat belt at the torso position in a vehicle collision. Table 1 compares the performance of load limiting and PET seat belt webbings and shows the reduction of force against the occupant and improvement of injury criteria. As those skilled in the art know, in Docket 74-14: 49 C.F.R. Parts 571,572, and 585, pulse rate means acceleration expressed as a multiple of g (which is the acceleration of gravity). HIC means the Head Injury Criteria. Chest mm means the chest deflection of the vehicle occupant.

TABLE I

| Test no. | Pulse | Lap (kN) | Torso (kN) | HIC | Chest (g) | Chest (mm) | Pelvis (g0 | Femur kN |
|---|---|---|---|---|---|---|---|---|
| Inventive Example | 28 g 40 mph | 6 | 6 | 436 | 45 | 36.3 | 40 | 0.9/−1.4 L 1.2/−0.2 R |
| Comparative | 40.5 g 36 mph | 8.5 | 9.7 | 974 | 59.9 | 64 | 55.9 | 1.8/−4.5 L 1.8/−1.6 R |

What is claimed is:

1. A webbing having a force-displacement profile comprising:

(a) when said webbing is subjected to a knuckle point force in the range from about 400 pounds (about 1.8 kilonewtons) to about 900 pounds (about 4.0 kilonewtons), said webbing elongates to less than about five percent;

(b) upon subjecting said webbing to greater than said knuckle point force and to less or equal to about 1,400 pounds (about 6.2 kilonewtons), said webbing elongates further to at least about ten percent; and (c) upon subjecting said webbing to greater than 1,400 pounds (about 6.2 kilonewtons), the modulus increases sharply and said webbing elongates further until said webbing breaks at a tensile strength of at least about 5,000 pounds (about 22 kilonewtons).

2. The webbing of claim 1 wherein in part (a), said webbing elongates to less than about three percent.

3. The webbing of claim 1 wherein in part (b), said webbing elongates to at least about 15 percent.

4. The webbing of claim 1 wherein said webbing is made from yarn having a force-displacement profile comprising:

a) when said yarn is subjected to an initial stress barrier of from about 0.8 gram/denier to less than or equal to about 1.2 grams/denier, said yarn elongates to less than 5 percent and has an initial modulus in the range from about 30 grams/denier to about 80 grams/denier;

b) upon subjecting said yarn to greater than said initial stress barrier and to less than or equal to about 1.5 grams/denier, said yarn elongates further to at least about 8 percent; and c) upon subjecting said yarn to greater than 1.5 grams/denier, the modulus increases sharply and said yarn elongates further until said yarn breaks at a tensile strength of at least 6 grams/denier wherein said yarn comprises a multiplicity of fibers and all of said fibers have substantially the same force-displacement profile.

5. The webbing of claim 1 wherein said webbing is dyed.

6. The webbing of claim 1 wherein said webbing is used as safety seat belt and comprises at least 300 ends of warp yarn and at least one weft yarn.

7. The webbing of claim 6 wherein said warp yarn has a denier of about 800 to about 2,000 and a fiber denier from about 2 to about 30.

8. The webbing of claim 6 wherein said weft yarn has a denier of about 200 to about 1,000 and a fiber denier from about 1 to about 1,000.

9. The webbing of claim 1 wherein said webbing is comprised of yarn made from block copolymer of aromatic polyester and lactone monomer and said block copolymer has a glass transition temperature in the range from about −20° C. to about +60° C.

10. The webbing of claim 9 wherein said aromatic polyester is polyethylene terephthalate.

11. The webbing of claim 9 wherein said lactone monomer is ϵ-caprolactone.

12. The webbing of claim 9 wherein said block copolymer comprises ultraviolet absorber, hindered amine light stabilizer, antioxidant, pigment and other additives.

13. The webbing of claim 12 wherein said ultraviolet absorber is selected from the group consisting of benzophenones, benzotriazoles, triazines, and oxanilides.

14. The webbing of claim 12 wherein said antioxidant is selected from the group consisting of hindered phenolics, hindered benzoates, hindered amines, and phosphites/phosphonites.

15. The webbing of claim 12 wherein at least one of said ultraviolet absorbers is employed in an amount of about 0.1 to about 2.0 weight percent and/or at least one of said hindered amine light stabilizers is employed in an amount of about 0.1 to about 2.0 weight percent and/or at least one of said antioxidants is employed in an amount of about 0.1 to about 2.0 weight percent, based on the total weight of said block copolymer.

16. A process for making load limiting webbing comprising the step of:

heating said webbing at a temperature from about 120° C. to about 180° C. under sufficient tension or shrinkage so to achieve said treated webbing which has a force-displacement profile comprising:

i) when said webbing is subjected to a knuckle point force in the range from about 400 pounds (about 1.8 kilonewtons) to about 900 pounds (about 4.0 kilonewtons), said webbing elongates to less than about five percent;

ii) upon subjecting said webbing to greater than said knuckle point force and to less or equal to about 1,400 pounds (about 6.2 kilonewtons), said webbing elongates further to at least about ten percent; and iii) upon subjecting said webbing to greater than 1,400 pounds (about 6.2 kilonewtons), the modulus increases sharply and said webbing elongates further until said webbing breaks at a tensile strength of at least about 5,000 pounds (about 22 kilonewtons).

17. The process of claim 16 which additionally comprises the step of:

prior to said heat treatment of said webbing, weaving a yarn having a force-displacement profile comprising:

a) when said yarn is subjected to an initial stress barrier of from about 0.8 gram/denier to less than or equal to about 1.2 grams/denier, said yarn elongates to less than 5 percent and has an initial modulus in the range from about 30 grams/denier to about 80 grams/denier;

b) upon subjecting said yarn to greater than said initial stress barrier and to less than or equal to about 1.5 grams/denier, said yarn elongates further to at least about 8 percent; and c) upon subjecting said yarn to greater than 1.5 grams/denier, the modulus increases sharply and said yarn elongates further until said yarn breaks at a tensile strength of at least 6 grams/denier wherein said yarn comprises a multiplicity of fibers and all of said fibers have substantially the same force-displacement profile.

18. The process of claim 16 which additionally comprises the step of:

prior to heat treatment of said webbing, scouring said webbing and/or padding said webbing in a bath.

19. The process of claim 18 wherein said bath comprises dye.

20. The process of claim 19 wherein said dye is a disperse dye.

21. The process of claim 18 wherein said bath may contain a dye carrier.

22. The process of claim 18 wherein said bath comprises a ultraviolet absorber and/or antioxidant.

23. The process of claim 16 which additionally comprises the step of: after said padding and before said heat treatment, drying said padded webbing at a temperature range from about 60° C. to about 170° C.

24. The process in claim 16 which additionally comprises the step of: after heat treatment of said webbing, coating said webbing with an overfinish.

* * * * *